US005195626A

United States Patent [19]

Le Hong et al.

[11] Patent Number: 5,195,626

[45] Date of Patent: Mar. 23, 1993

[54] DEVICE FOR CHECKING COINS

[76] Inventors: Son Le Hong, 5 Rue de Chevreuse, Villebon sur Yvette, France, 91140; Claude Rigolet, 13 Rue du Flamant rose, Limours, France, 91470

[21] Appl. No.: 623,908

[22] PCT Filed: Jun. 20, 1989

[86] PCT No.: PCT/FR89/00314

§ 371 Date: Dec. 21, 1990

§ 102(e) Date: Dec. 21, 1990

[87] PCT Pub. No.: WO89/12872

PCT Pub. Date: Dec. 28, 1989

[30] Foreign Application Priority Data

Jun. 21, 1988 [FR] France ..... 88 08322

[51] Int. Cl.[5] ..... G07D 5/08

[52] U.S. Cl. ..... 194/317; 453/3; 453/57

[58] Field of Search ..... 194/317; 453/3, 6, 10, 453/12, 32, 33, 34, 57, 49

[56] References Cited

U.S. PATENT DOCUMENTS 1,210,732 1/1917 Voglesong ..... 453/3 X
4,234,071 11/1980 Le-Hong ..... 194/317
4,548,220 10/1985 Le Hong et al. ..... 453/3
4,752,274 6/1988 Abe ..... 453/33 X

FOREIGN PATENT DOCUMENTS 2408183 7/1981 France .
2542475 9/1984 France .
2128795 5/1984 United Kingdom .

*Primary Examiner*—F. J. Bartuska
*Attorney, Agent, or Firm*—Young & Thompson

[57] ABSTRACT

Device for checking metal disks and especially coins, characterized in that it comprises a sorting mechanism essentially constituted by a single motor-driven circular plate 4 which makes it possible to carry out simultaneously the functions of separation and identification of coins, this plate being toothed around its periphery and reinforced at the center by a portion 9 of frusto-conical shape onto which the coins fall in a bulk admission zone. This plate rotates above a stationary portion 2 which is almost entirely surrounded by a circular rim 3 on which the coins slide when they are engaged between the teeth of the plate. Provision is made for the identification and authentication of coins, which take into account both the material, the thickness and the diameter of these latter, including a single electromagnetic detector 15 placed above the plate 4. The detector is eccentric to the path of the centers of the coins, so that variation in the diameters of the coins can be detected.

19 Claims, 2 Drawing Sheets

DEVICE FOR CHECKING COINS

The device for automatically checking metal disks and especially coins which forms the subject of the present invention is intended for sorting, identification and authentication of all types of present or future coins or metal disks having similar dimensions such as tokens, for example.

The devices for checking coins which are known at the present time perform the sorting operation by checking the characteristics of the coins, either by mechanical means for weight, diameter and thickness, or by electromagnetic means with sensors necessarily placed in an environment of non-metallic material.

As the case may be, they have the following defects :

- either they are too slow for automatic sorting applications, which is the case of slot machines for pedestrians,
- or else they are unreliable in the discrimination and identification of coins, as is the case with devices having feelers, vibrators or rollers involving a large number of small mechanical parts which are subject to frequent disadjustments and are consequently difficult and costly to maintain,
- or else they are sensitive to the environment, for example to dirt in the case of infrared detectors and are finally unstable in the maintenance of performances,
- or finally they have a very complicated design with too many elements which are both fragile and excessively costly, this being the case of devices which employ a first disk for separation of the coins and a second disk for their detection and identification; this latter and its support are of plastic and therefore rather vulnerable. Furthermore, in these devices, the coins have to be separated one by one by means of a compartmented disk prior to detection. However, since this separation is not possible for coins having a diameter smaller than the radius of the largest coin which is accepted, this results in errors of identification.

The device for checking metal parts which forms the subject of the present invention is intended to remove the above-mentioned disadvantages. This latter is characterized in that it comprises a sorting mechanism essentially constituted by a single motor-driven circular plate which makes it possible to carry out simultaneously the functions of separation and identification of disks. This plate is toothed around its entire periphery and reinforced at the center by a portion of frusto-conical shape onto which the disks fall in a bulk admission zone. This arrangement makes it possible to disperse them very rapidly and to distribute them at the periphery. This plate rotates above a stationary portion which is surrounded almost entirely by a circular rim except in an exit zone for normal discharge of disks and on which the disks slide when they are engaged between the teeth of the plate.

This device is also provided with means for identification and authentication of disks, which mainly comprise an electromagnetic detector placed in a detection zone at the level of passing of the teeth of the plate. A signal processor makes cyclic and continuous comparisons between the items of information generated as the disks pass beneath the detector and recorded data corresponding to a model of items of information characterizing each type of disk which can be accepted by the device.

This device which has few mechanical components is very simple to construct and does not require any complicated adjustment. The large diameter of the toothed circular plate which is not limited in principle permits a large number of teeth and of spaces between teeth, thus enabling it to capture a large quantity of disks at each revolution. Since the detector for identification of disks is located at less than one half-revolution from their point of entry, the result thereby achieved is that, at a given speed of rotation, the total length of time required for checking a batch of disks is as short as possible. Moreover, this device makes it possible to accept and to authenticate two disks within a single space between teeth, thus constituting a considerable improvement with respect to the current technique which required separation of the disks one by one and gave rise to errors of identification.

Preferably, the toothed circular plate, the stationary portion and the circular rim are of metal.

The metal construction of these elements eliminates premature wear by guarding against hammering at the surface by the impact of disks within the admission zone and by preventing the formation of scratches by friction during their rotation.

The variations of the analog signal generated by the metal teeth of the plate as they pass beneath the detector have a cyclic and repetitive aspect which is utilized by the processor in order to carry out their discrimination with respect to the signal variations produced by the disks.

Preferably also, the toothed circular plate and the stationary portion are entirely of frusto-conical shape from the center to the periphery.

This form offers the advantage of facilitating the insertion of the disks between the teeth of the plate and of keeping them in contact with the circular rim during their entire path of travel, before the exit zone, especially in the detection zone in which this increases the precision in the case of identification of disks which may be very similar to each other.

Furthermore, in accordance with the invention, the device advantageously comprises a mechanical thickness-limiting bar located above the toothed circular plate, from the center to the periphery, between the bulk admission zone and the detection zone.

This limiter makes it possible to thrust back the disks which are not inserted in a space between teeth and to limit to two the number of disks which can remain inserted therein before reaching the detection zone.

Furthermore, the device in accordance with the invention advantageously comprises an additional electromagnetic detector in the detection zone. This makes it possible to increase the accuracy of identification of disks in the case of types of disks which may be very similar to each other.

Since this detector is in a slightly displaced position with respect to the first detector, the corresponding processing operation performed by the processor permits a very detailed analysis for each disk and consequently finer discrimination between those which have very closely related characteristics.

The device in accordance with the invention advantageously comprises in addition an angular-position synchronization encoder coupled to the shaft of the toothed circular plate. This encoder mainly provides synchronization of sampling of the measurements of identification of disks as a function of the angular positions of the plate and the device is thus permitted to remain insensitive to variations in the speed of rotation.

In addition, the device is provided with means for automatic discharge of disks, said means mainly comprising two shutters which are hinged on the stationary portion. In the closed position, they constitute a portion of the circular rim at the periphery of the bulk admission zone.

These shutters open when the speed of rotation of the circular plate decreases, for example under the influence of falling of objects which tend to brake or arrest the motion of the plate by reason of their shape or dimensions. They accordingly allow all the objects located in the bulk admission zone to escape to the exterior under the action of gravity before reclosing automatically.

The device in accordance with the invention comprises in addition a mechanism for the visual display of disks, batch by batch, said mechanism being located beneath the exit zone of the toothed circular plate. It is composed of an inclined sliding surface onto which the disks fall under the action of gravity and of a transparent rotary disk. This latter is provided on its bottom face with arms and with two concentric rings which slide on the surface and which determine sectors, on the one hand in a central portion in order to receive in each sector the disks of one and the same batch which are accepted by the processor and on the other hand in a peripheral portion in order to receive any disks of this batch which may have been rejected. These latter are previously diverted by a retractable deflection barrier located in the normal exit zone of the circular plate and controlled automatically before they pass in order to form an extension of the circular rim. One separate discharge opening per zone is also formed in the top portion of the sliding surface of this mechanism.

This visual display mechanism serves to show the batches of disks which have most recently been thrown into the device in order to provide the possibility of checking their composition in the event of litigation.

In a particular form of the invention, the device comprises a retractable guide bar located upstream of the zone of normal exit of the disks from the sorting mechanism. In a normal position, this bar constitutes a portion of the circular rim which surrounds the toothed circular plate. In a withdrawn position, it allows the disks to pass directly through a branch exit.

By preventing the disks from passing through the visual display mechanism, this arrangement makes it possible temporarily to overcome any faulty operation of this latter by allowing the device for checking disks to remain in service in a degraded mode or in other words without visual display.

It should finally be added that the device is equipped with a hinged trap-door which constitutes a portion of the sliding surface in the closed position, said portion being located in the peripheral portion of the visual display mechanism. In the open position, this trap-door uncovers a branch exit.

This branch exit permits direct recovery of rejected disks as soon as they have left the sorting mechanism.

One embodiment of the device is illustrated in the accompanying drawings, wherein.

Figure 1:
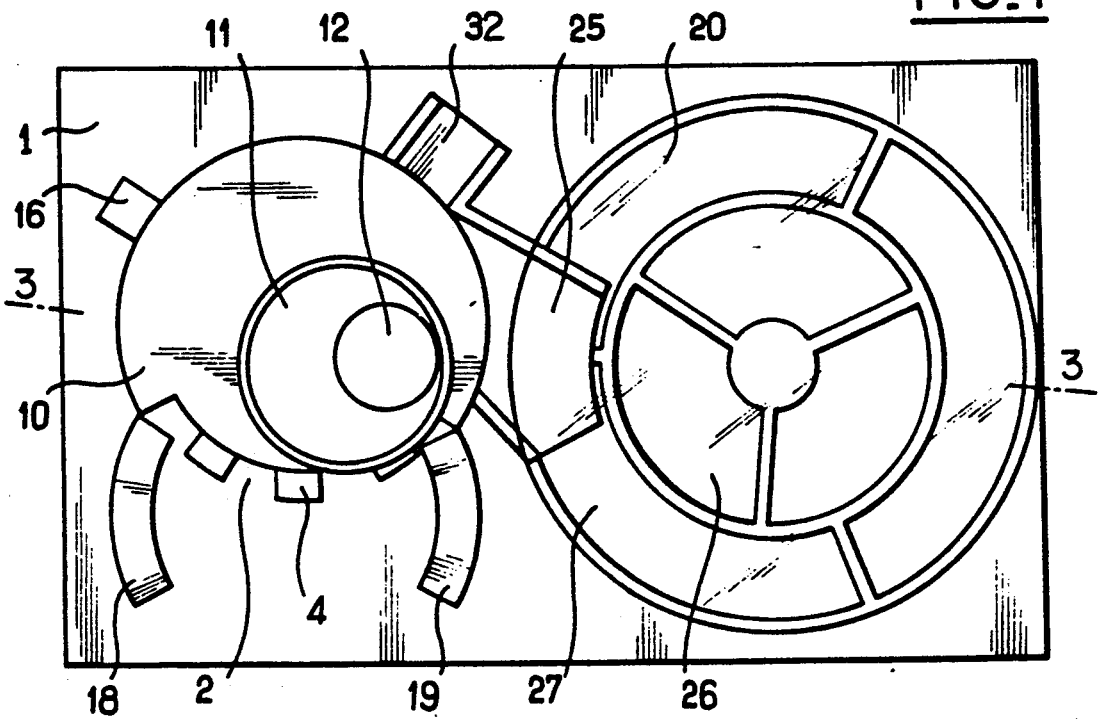
FIG. 1 is a top view which illustrates the device provided with its cover and with the automatic discharge shutters in the open position.
Figure 2:
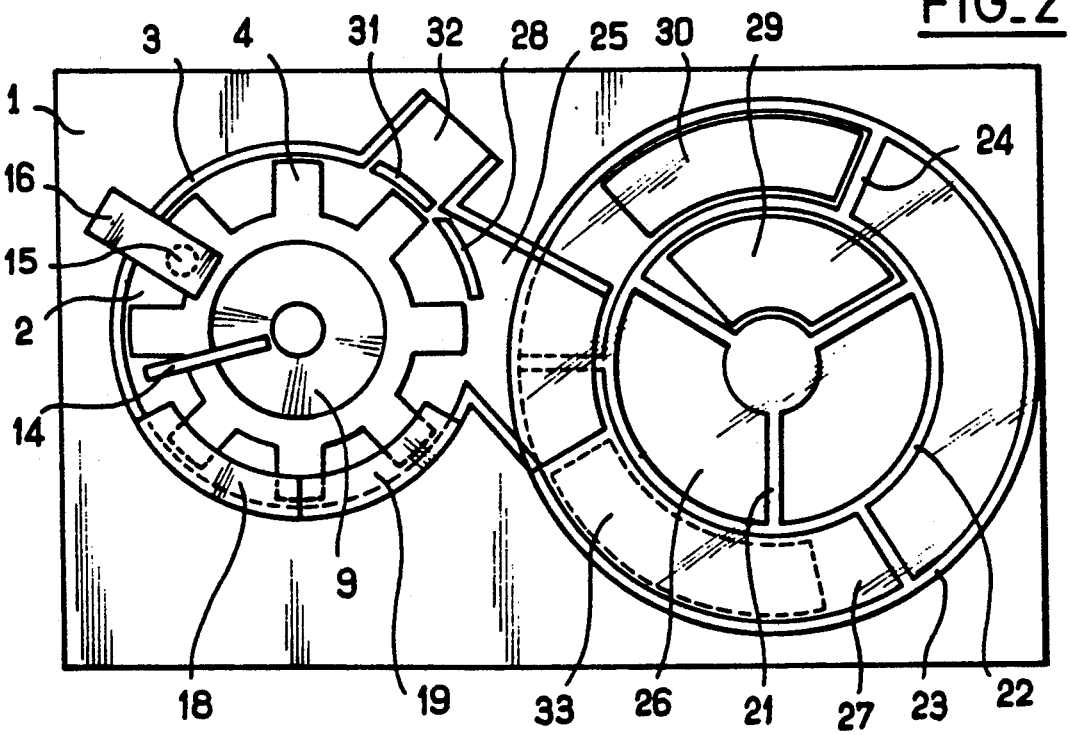
FIG. 2 is a top view which illustrates the device with the cover removed and with the automatic discharge shutters in the closed position.
Figure 3:
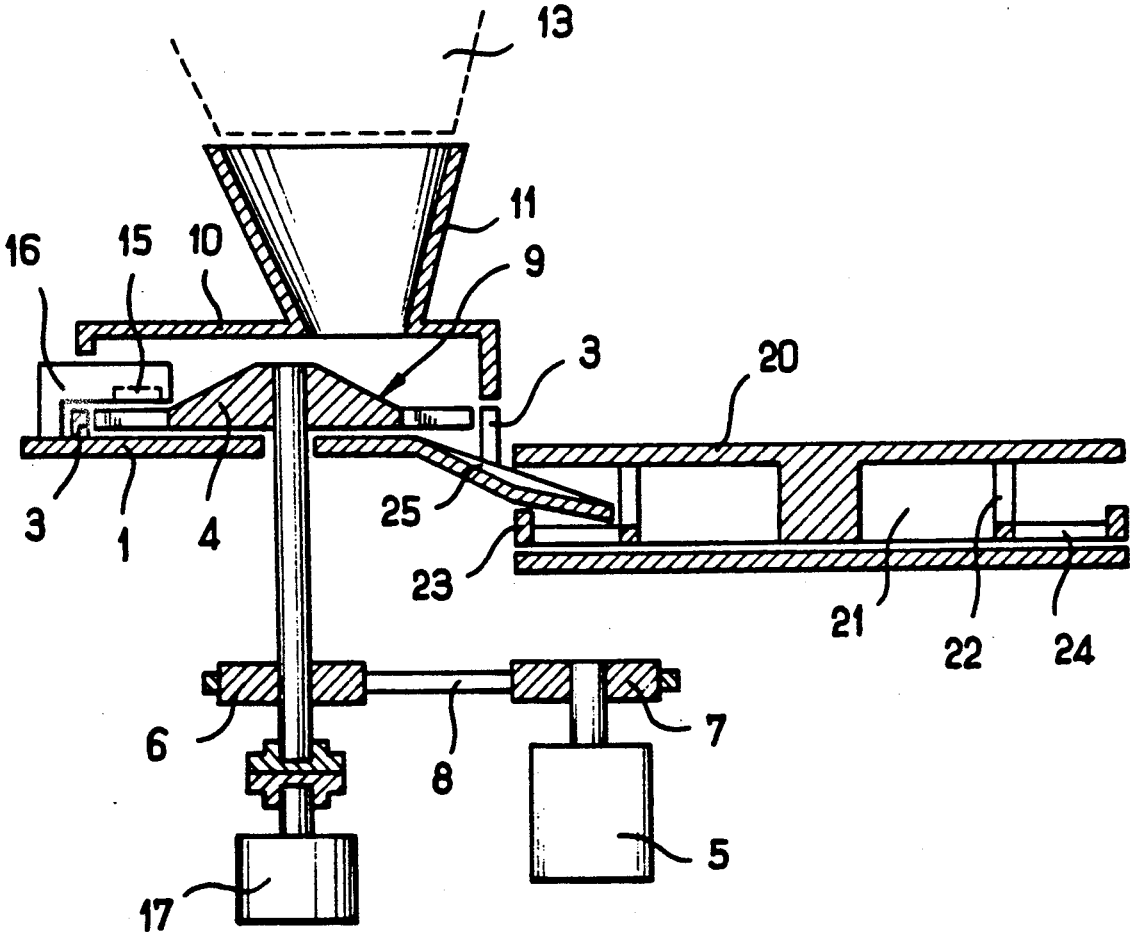
FIG. 3 is a view in cross-section on the line 3—3 in FIG. 1.

This embodiment of the device for checking metal disks comprises in accordance with FIGS. 1 to 3 a frame 1 provided with a circular track 2 which constitutes a sliding surface. A large part of this latter is surrounded by a rim 3 which is also circular and which surrounds a toothed circular plate 4 having partially a frusto-conical shape at the center, said plate being driven in rotation above the sliding surface by a motor 5 by means of two toothed wheels 6 and 7 and a belt 8. The frusto-conical portion 9 causes the disks or coins, as soon as they fall, to slide towards the peripheral portion of the bulk admission zone.

A removable cover 10 is placed above the circular plate. This cover is provided with a funnel 11, the bottom opening 12 of which opens onto the frusto-conical portion of the circular plate, thus causing the coins to fall at this point, said coins being thrown in the loose state for example into a basket 13, the bottom of which is open directly opposite to the top of the funnel. The internal shape of the cover is such that, as they enter, the coins are applied on the frusto-conical portion of the circular plate before being distributed between the teeth at the periphery of this latter.

The toothed circular plate has teeth of small thickness and, depending on their dimensions, either one or two coins can find room within the inter-tooth space which exists between two consecutive teeth.

A mechanical limiter constituted by a bar 14 serves to prevent the coins from passing into the detection zone without being placed between two teeth of the plate.

A detector 15 fixed on a support 16 and comprising a coil mounted within a half-pot of ferrite constitutes the sensitive element of a means for identification of coins which makes use of a programmed processor. This latter processes the analog signal delivered by an electronic oscillator on which the detector acts as a variable impedance. The variations of the signal in frequency and in amplitude as a result of passing of a coin beneath said detector are a function both of the diameter of this coin, of its thickness and of the constituent material of this latter. This detector of circular shape is located on the one hand above the point at which the coin passes on the sliding surface 2 in order that the air-gap between detector and coin should result from the thickness of this latter and, on the other hand, at a distance from the rim 3 such that the coin intersects the magnetic field of said detector as a function of its diameter. The coin has an influence by means of its material on the apparent reluctance of the magnetic circuit which it constitutes with the ferrite half-pot of the detector. It also acts by means of the losses by induced currents produced within its mass.

Processing of the signal is repeated cyclically and continuously at a frequency such that calculation of the variations in frequency and amplitude of the signal is carried out several tens of times while the coin is passing beneath the detector. The results of these calculations are continuously compared with recorded data corresponding to a model characterizing each type of coin which can be accepted by the device.

An angular-position encoder 17 which is directly coupled to the shaft of the circular plate delivers about one thousand pulses per revolution which are employed for synchronizing the sampling of measurements of detection of coins and for initiating identification processing operations.

Two hinged shutters 18 and 19 constitute the movable front portion of the circular rim which surrounds the toothed circular plate. These shutters are automatically actuated by the processor so as to open toward the front when the speed of rotation of the circular plate decreases.

A transparent disk 20 which has three arms 21 and two concentric rings 22 and 23 connected to each other by means of cross-pieces 24 and which slides in rotation on a fixed surface receives, when it is stationary, the coins which come from the exit of the toothed circular plate by means of a transition passageway 25 on which the circular movement of the coins is converted to a rectilinear movement. This transition passageway which penetrates directly into the transparent disk guides the coins up to a sector of its central portion 26 or of its peripheral portion 27, depending on whether the deflection barrier 28 which forms an extension of the rim 3 is withdrawn or not.

This barrier is controlled automatically by the processor and is in the deflection position if the coin to be displayed is rejected.

Before the arrival of the first coin of a fresh batch, the processor initiates rotation of the transparent disk by one third of a revolution in order to ensure that the following sectors appear in front of the transition passageway.

When a batch carries out its second third of a revolution, the corresponding coins fall through the openings 29 and 30 in order to be discharged to a storage location.

A bar 31 which constitutes a portion of the rim 3 is retractable in order to permit direct discharge of coins through a branch opening 32 in the event of unavailability of the visual display mechanism, for example.

A trap-door 33 makes it possible in the open position to divert to a recovery exit the rejected coins which drop onto the peripheral portion of the visual display mechanism. When this trap-door is in the closed position, the coins remain on the sliding surface until they arrive at the exit opening 30.

The device in accordance with the invention is particularly intended for applications involving toll payment acquisition on turnpikes, at the entrance of parking lots and at all locations in which users have to pay an entrance fee or a tourist tax.

It is also intended for applications which involve sorting in the field of automatic checking of manufacture of small metal disks, for example, and in the banking field for authentication of coins prior to packaging.

What is claimed is:

1. A device for checking metal disks, said device comprising means (4) for transferring disks one by one so that the centers of the disks move along a predetermined path of travel, and means for identification and authentication of disks which take into account the material, the thickness and the diameter of said disks, said authentication means being constituted by an electromagnetic detector (15) placed above the path of travel of the centers of the disks so as to detect the air-gap between the detector and the disks which varies with the thickness of the disks, said position of the electromagnetic detector being eccentric with respect to said path of travel of the centers of the disks, whereby the area of the magnetic field of the detector which is intersected by the disks depends on the diameter of the disks, the identification and authentication means moreover comprising means for comparing the signal produced by the detector as the disks pass with recorded data corresponding to an information model characterizing each type of disk which can be accepted by the device, wherein the means for transferring the disks one by one along a predetermined path of travel include a single motor-driven circular plate (4) which makes it possible to perform simultaneously the functions of separation and identification of disks, said plate being toothed along its periphery and reinforced at the center by a portion (9) of frusto-conical shape onto which the disks fall in a bulk admission zone, said plate being rotatable above a stationary portion (2) which is almost entirely surrounded by a circular rim (3) on which the disks slide when they are engaged between the teeth of the plate, said device moreover comprising means for automatic discharge of disks, said means comprising two shutters (18, 19) which are hinged no the stationary portion (2) and which constitute in the closed position a portion of the circular rim (3) at the periphery of the bulk admission zone and which, when they open allow all the disks located in this zone to escape to the exterior.

2. A device according to claim 1, wherein the toothed circular plate, the stationary portion and the circular rim are of metal.

3. A device according to claim 1, wherein the toothed circular plate and the stationary portion are entirely of frusto-conical shape from the center to the periphery.

4. A device according to claim 1, comprising an angular-position synchronization encoder coupled to the shaft of the toothed circular plate.

5. A device according to claim 1, wherein the comparison means cyclically and continuously compare with the recorded data the information generated as the parts pass beneath the detector, said information being the result of variations in frequency and amplitude of the signal delivered by an electronic oscillator on which the detector acts as a variable impedance.

6. A device according to claim 1, comprising a mechanical thickness limiting bar located above the path of travel of the parts between a bulk admission zone and the detection zone.

7. A device according to claim 5, comprising a mechanical thickness limiting bar located above the path of travel of the parts between a bulk admission zone and the detection zone.

8. A device for checking metal disks, said device comprising means (4) for transferring the disks one by one along a predetermined path of travel, and means for identification and authentication of disks which take into account the material, the thickness and the diameter of the disks, said authentication means being comprised by an electromagnetic detector (15) placed above the path of travel of the centers of the disks so as to detect the air-gap between the detector and the disks which varies with the thickness of the disks, said position of the electromagnetic detector being eccentric with respect to said path of travel of the centers of the disks, whereby the area of the magnetic field of the detector which is intersected by the disks depends on the diameter of the disks, the identification and authentication means moreover comprising means for comparing the signal produced by the detector as the disks pass with recorded data corresponding to an information model characterizing each type of disk which can be accepted by the device, said device comprising beneath an exit zone of the means for transferring the disks a mechanism for visual display of the disks batch by batch, comprised by an inclined sliding surface onto which the disks fall and a transparent rotary disk (20) provided on a bottom face thereof with arms (21) and with two concentric rings (22, 23) which slide on the sliding surface and determine first sectors in a first circular portion of the sliding surface in order to receive in each first sector the disks of one and the same batch which are accepted by the identification and authentication means, and second sectors in a second circular portion of the sliding surface in order to receive any parts of this batch which may have been rejected, these rejected disks being previously diverted by a retractable deflection barrier (28) located in said exit zone and controlled automatically before the rejected disks pass; one discharge opening (29, 30) being formed in a discharge zone of each of said first and second circular portions of the sliding surface.

9. A device according to claim 8, equipped with a retractable guide bar (31) which is located upstream of said exit zone and constitutes in a normal position a portion of a rim (3) for guiding disks along said path of travel and which, in the withdrawn position, allows the disks to pass directly through a branch exit (32) which makes it unnecessary for the disks to travel through the visual display mechanism.

10. A device according to claim 8, equipped with a hinged trap-door (33) which constitutes, in a closed position, part of the second circular portion of the sliding surface and which forms, in an open position, a branch exit for rejected disks.

11. A device according to claim 8, wherein the comparison means cyclically and continuously compare with the recorded data the information generated as the parts pass beneath the detector, said information being the result of variations in frequency and amplitude of the signal delivered by an electronic oscillator on which the detector acts as a variable impedance.

12. A device according to claim 8, comprising a mechanical thickness limiting bar located above the path of travel of the parts between a bulk admission zone and the detection zone.

13. A device according to claim 11, comprising a mechanical thickness limiting bar located above the path of travel of the parts between a bulk admission zone and the detection zone.

14. A device for influencing a detector by successive metal disks, said device comprising means for transferring the disks so that the centers of the disks move one by one along a predetermined path of travel including a single motor-driven circular plate which makes it possible to perform simultaneously the functions of separation and identification of disks, said plate being toothed along its periphery and rotatable above a stationary portion which is almost entirely surrounded by a circular rim on which the disks slide when they are engaged between the teeth of the plate, and an electromagnetic detector placed above the path of travel of the disks so as to detect the material of the disks, the air-gap between the detector and the disks which varies with the thickness of the disks, whereby the area of the magnetic field of the detector which is intersected by the disks depends on the diameter of the disks, said device moreover comprising means for automatic discharge of disks, said means comprising two shutters which are hinged on the stationary portion, which constitute in the closed position a portion of the circular rim at the periphery of a bulk admission zone and which, when they open allow all the disks located in this zone to escape to the exterior.

15. A device according to claim 14, comprising a mechanical thickness limiting bar located above the path of travel of the disks circumferentially between a bulk admission zone and the detector.

16. A device according to claim 14, wherein said plate is reinforced at the center by a portion of frusto-conical shape onto which the disks fall in a bulk admission zone.

17. A device according to claim 14, wherein the toothed circular plate, the stationary portion and the circular rim are of metal.

18. A device according to claim 14, wherein the toothed circular plate and the stationary portion are entirely of frusto-conical shape from the center to the periphery.

19. A device for checking metal disks, said device comprising means for transferring the disks one by one along a predetermined path of travel, and means for identification and authentication of disks which take into account the material, the thickness and the diameter of the disks, said authentication means being comprised by an electromagnetic detector placed above the path of travel of the centers of the disks so as to detect the air-gap between the detector and the disks which varies with the thickness of the disks, said position of the electromagnetic detector being eccentric with respect to said path of travel of the centers of the disks, whereby the area of the magnetic field of the detector which is intersected by the disks depends on the diameter of the disks, the identification and authentication means moreover comprising means for comparing the signal produced by the detector as the disks pass with recorded data corresponding to an information model characterizing each type of disk which can be accepted by the device, said device comprising beneath an exit zone of means for transferring the disks a mechanism for visual display of the disks batch by batch, comprised by an inclined sliding surface onto which the disks fall and a transparent rotary disk provided on a bottom face thereof with arms and with two concentric rings which slide on the sliding surface and determine first sectors in a first circular portion of the sliding surface in order to receive in each first sector the disks of one and the same batch which are accepted by the identification and authentication means, and second sectors in a second circular portion of the sliding surface in order to receive any disks of this batch which may have been rejected, means being provided in the exit zone for selectively and automatically directing the disks of each batch towards a said first sector and towards a said second sector, one discharge opening being formed in a discharge zone of each of said first and second circular portions of the sliding surface.

* * * * *